US005081906A

United States Patent [19]

Lemaire et al.

[11] Patent Number: 5,081,906

[45] Date of Patent: Jan. 21, 1992

[54] MECHANISM, MOTOR PUMP, INCORPORATING PISTONS SUPPORTING, ROLLERS FOR ABUTMENT OF SAID PISTONS ON A CAM

[75] Inventors: Gilles Lemaire, Margny les Compiegne; Douglas Beeson, Paris, both of France

[73] Assignee: Poclain Hydraulics, France

[21] Appl. No.: 579,775

[22] Filed: Sep. 10, 1990

[30] Foreign Application Priority Data

Sep. 14, 1989 [FR] France ..... 89 12068

[51] Int. Cl.[5] ..... F01B 13/06; F04B 1/04

[52] U.S. Cl. ..... 91/491; 92/58; 417/273

[58] Field of Search ..... 417/273; 91/491, 492; 92/58

[56] References Cited

U.S. PATENT DOCUMENTS 3,913,455 10/1975 Green ..... 91/492
4,469,012 9/1984 Bigo et al. ..... 91/491
4,704,948 11/1987 Wüsthof et al. ..... 91/491
4,719,843 1/1988 Noel ..... 91/491

FOREIGN PATENT DOCUMENTS 0046691 3/1982 European Pat. Off. .
2160120 6/1973 France .
2224647 10/1974 France .
2582058 5/1985 France .
2097867 10/1982 United Kingdom .

*Primary Examiner*—Richard A. Bertsch
*Assistant Examiner*—Peter Korytnyk
*Attorney, Agent, or Firm*—Ladas & Parry

[57] ABSTRACT

This invention relates to a hydraulic mechanism comprising a cam; a cylinder-block mounted to rotate with respect to the cam; a plurality of cylinders arranged in this cylinder-block; a plurality of pistons mounted to slide inside a cylinder; a plurality of rollers for abutment of the pistons on the cam, each roller being mounted on a piston, rotating by means of a bearing for rotation, being axially defined by two transverse faces, and being capable of penetrating, at least partially, inside the cylinder in which this piston slides, the end of the piston comprising two recesses corresponding at least to the intersection of the cylindrical surfaces of the roller and of the piston, being open in the upper part of the piston; and two wedging pieces which are each disposed in a recess between the roller and the cylinder, in order to ensure axial wedging of the roller parallel to its axis of rotation. Along the axis of the piston, at least one of the two wedging pieces extends up to the lower part of the recess, so as, in the sense of extension of the piston out of the cylinder, to be displaced with said piston. One application is the production of a motor which is easy to machine.

12 Claims, 9 Drawing Sheets

FIG. 1
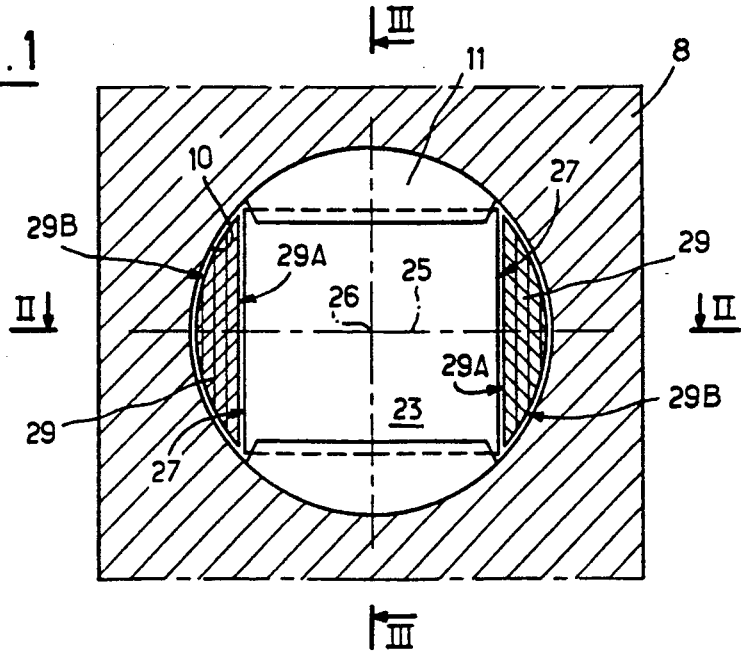
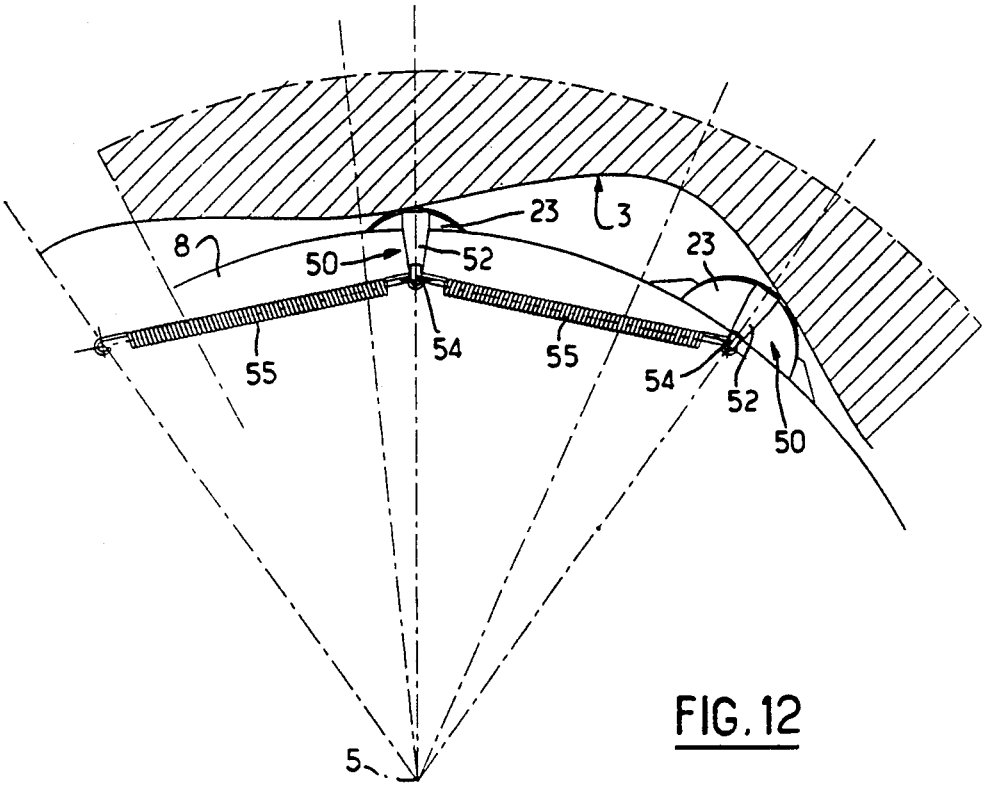
FIG. 12

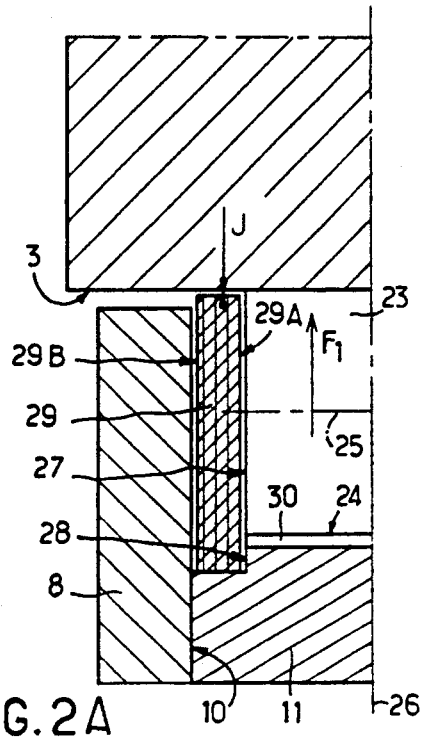
FIG. 2A
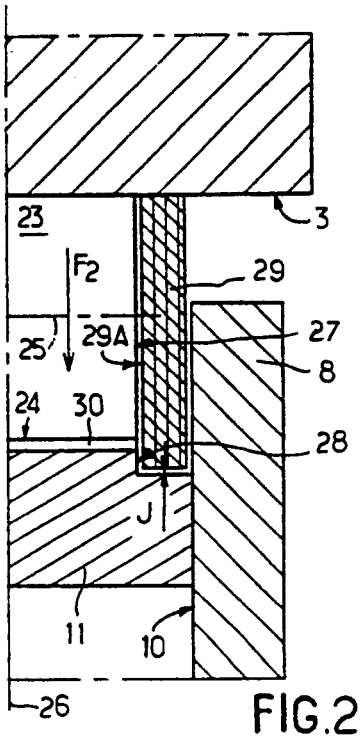
FIG. 2B
FIG. 3A
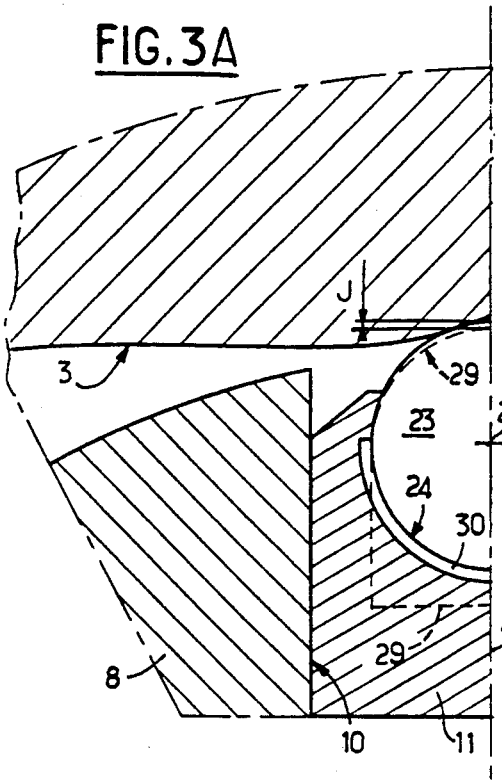
FIG. 3B
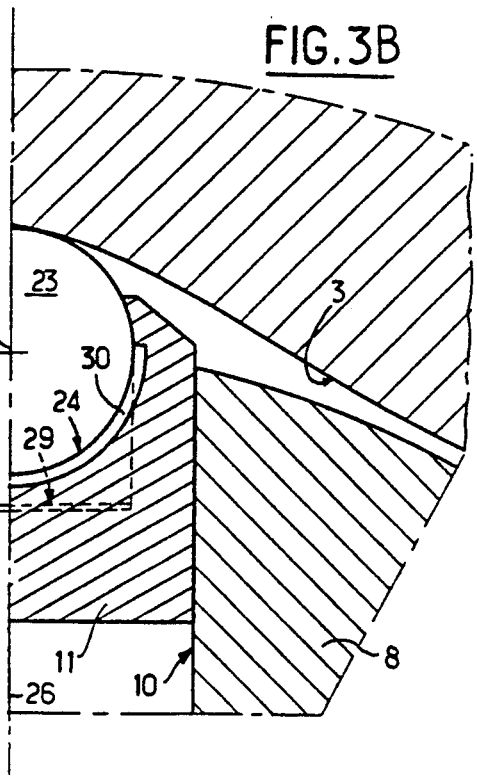

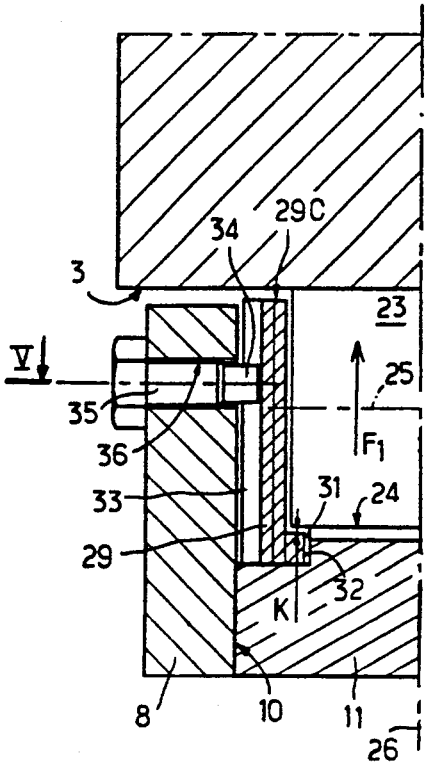
FIG. 4A
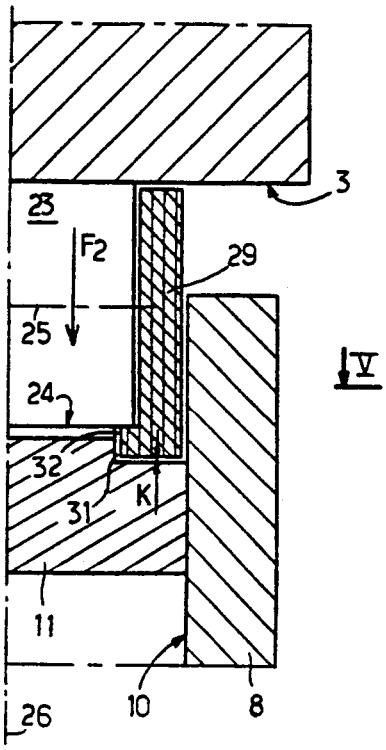
FIG. 4B
FIG. 5
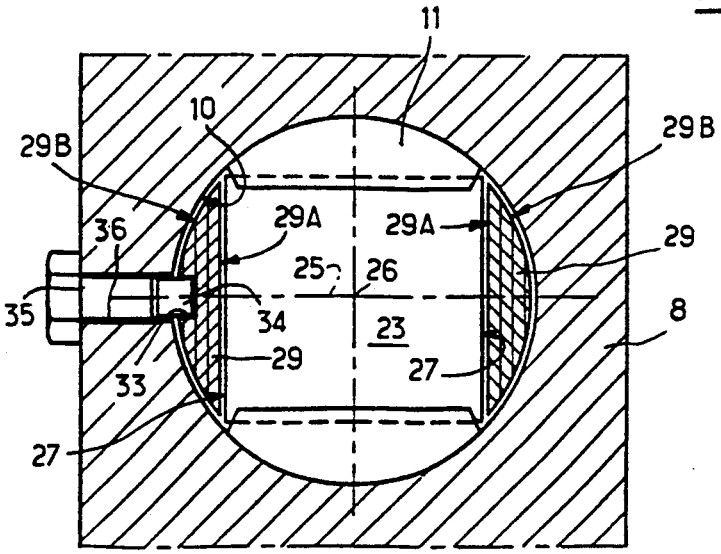

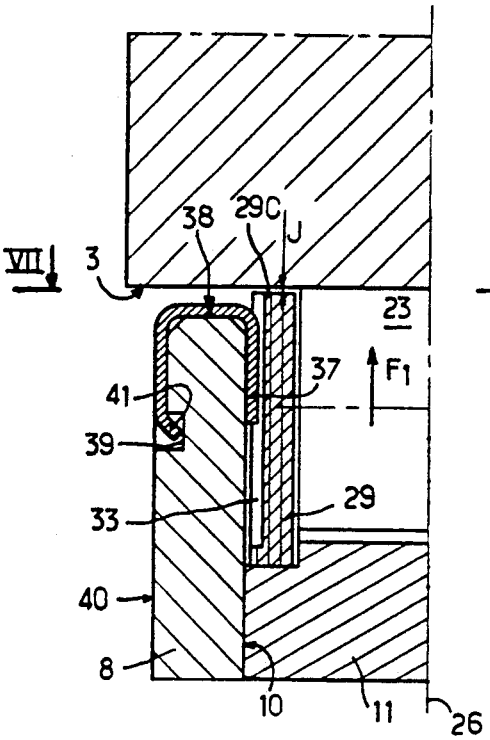
FIG. 6A
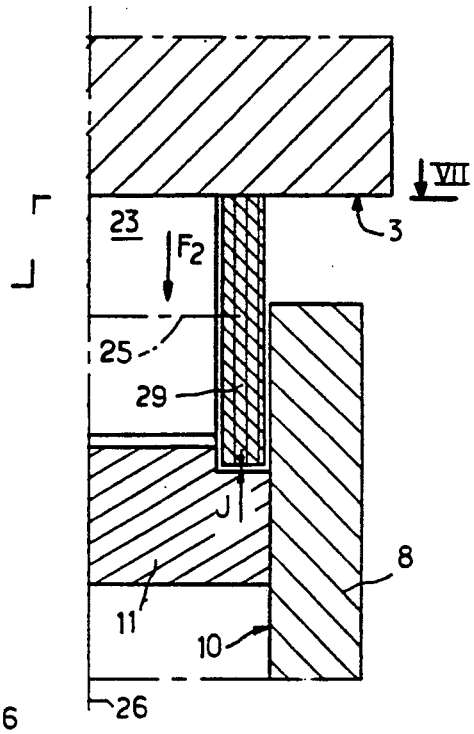
FIG. 6B
FIG. 7
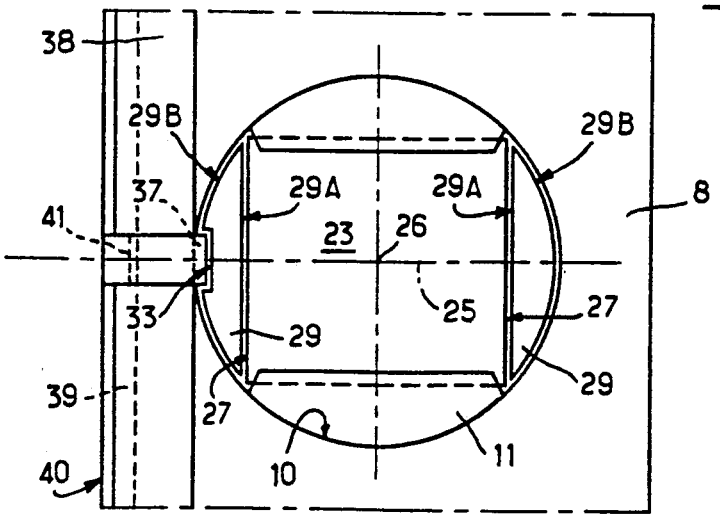

FIG. 10A
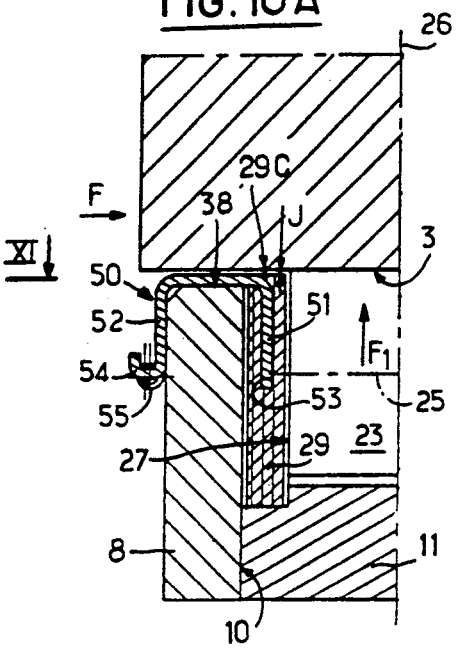
FIG. 10B
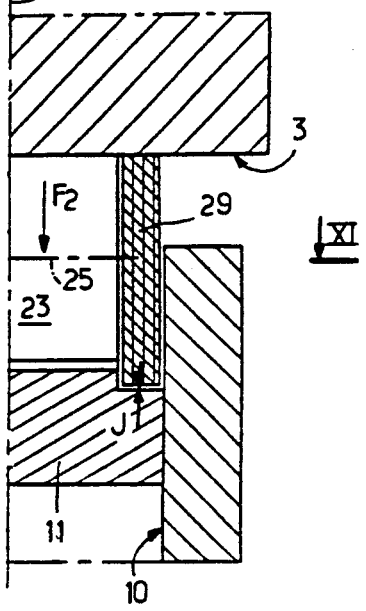
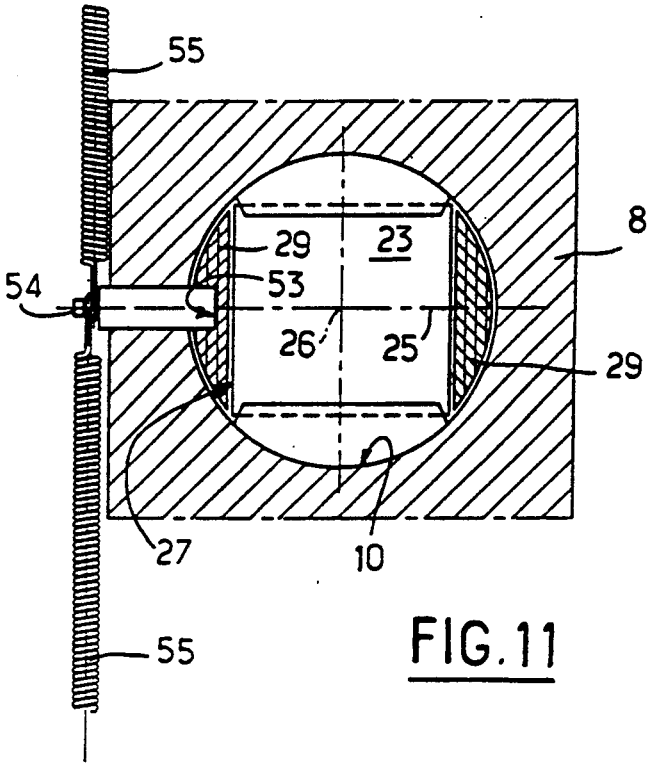
FIG. 11

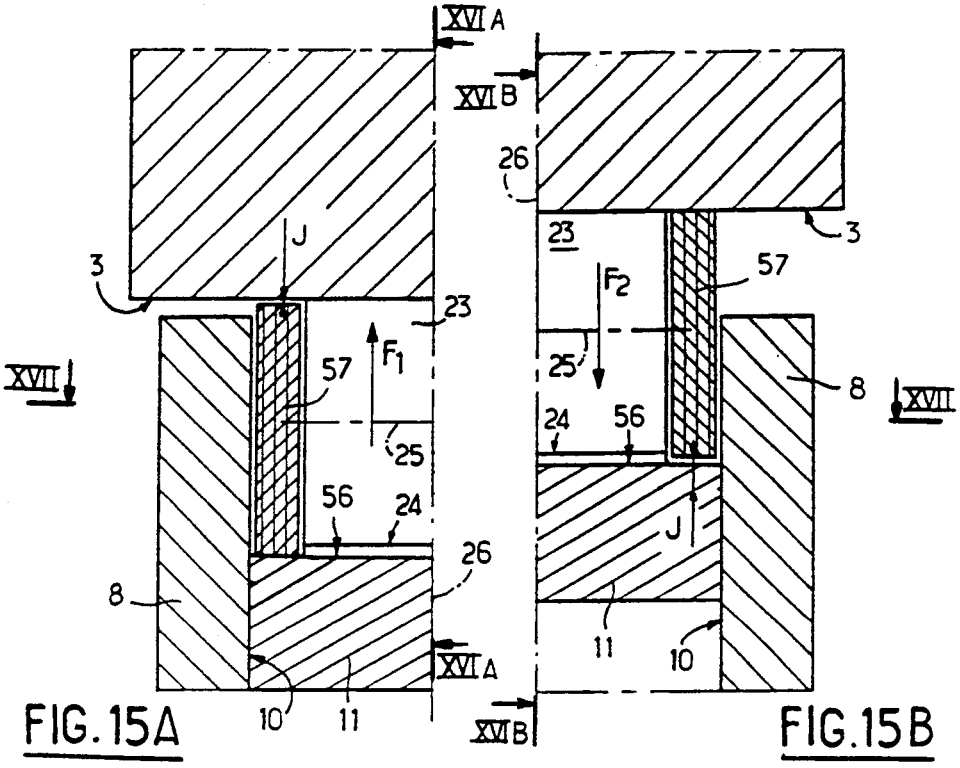
FIG. 15A
FIG. 15B
FIG. 16A
FIG. 16B
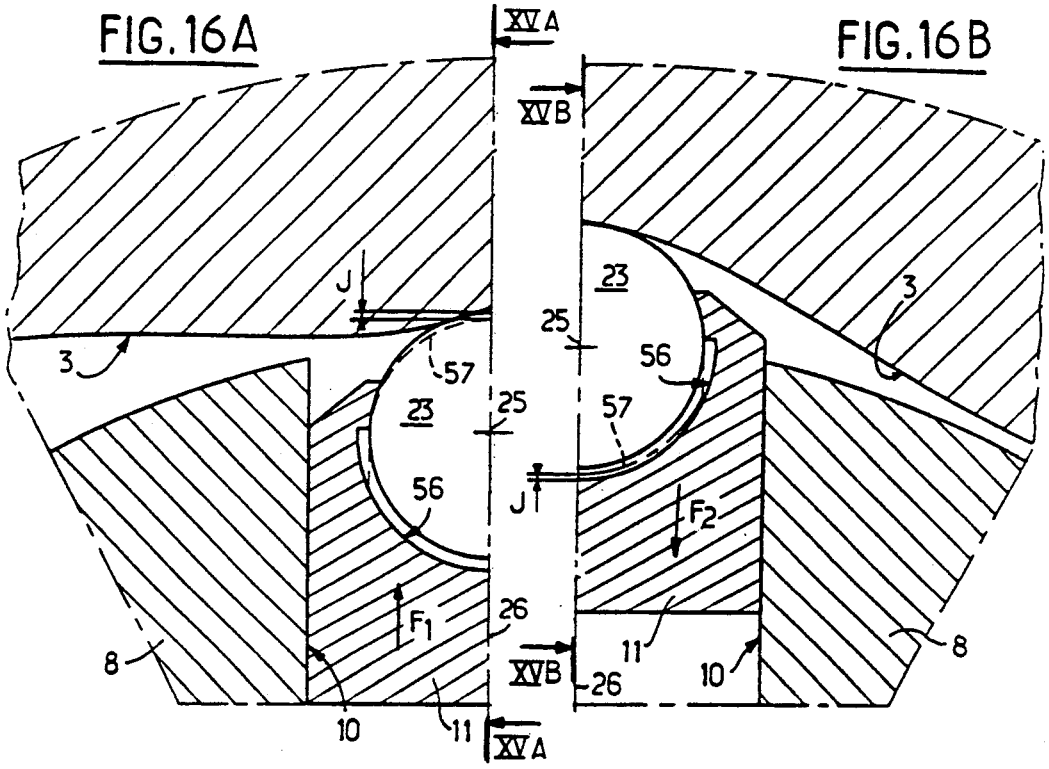

FIG. 17
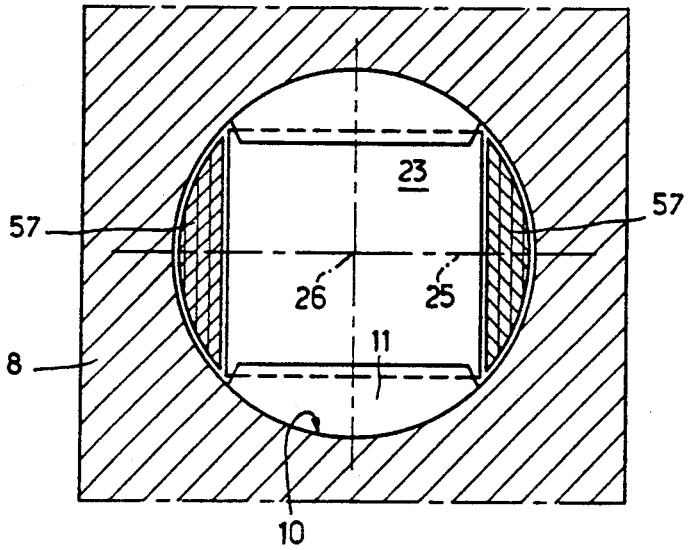
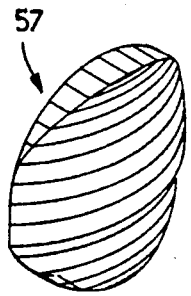
FIG. 18
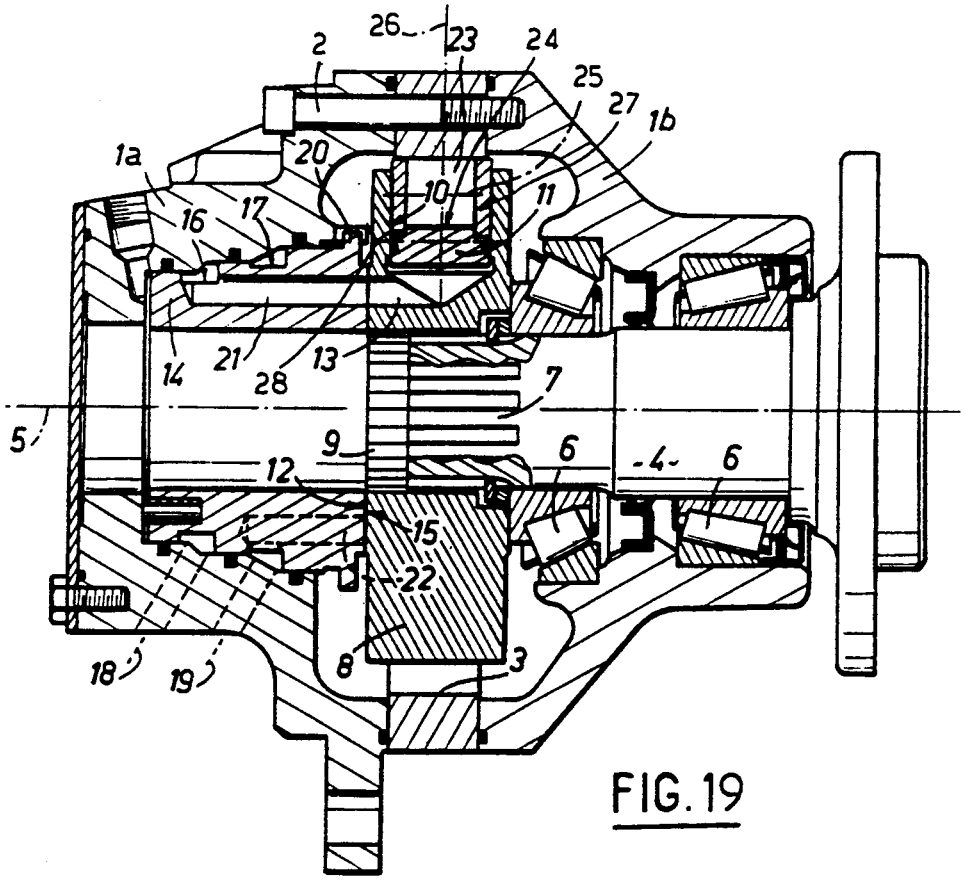
FIG. 19

MECHANISM, MOTOR PUMP, INCORPORATING PISTONS SUPPORTING, ROLLERS FOR ABUTMENT OF SAID PISTONS ON A CAM

FIELD OF THE INVENTION

The present invention relates to a mechanism, motor or pump, incorporating pistons supporting rollers for abutment of said pistons on a cam.

BACKGROUND OF THE INVENTION

FR-A-2 582 058 for example already discloses hydraulic mechanisms comprising a cam; a cylinder-block mounted to rotate with respect to the cam; a plurality of cylinders arranged in this cylinder-block; a plurality of pistons each mounted to slide inside a cylinder along an axis of slide of piston; a plurality of rollers for abutment of the pistons on the cam, each roller being mounted on a piston, rotating about a roller axis perpendicular to the axis of said piston by means of a bearing of rotation, being axially defined by two transverse faces, and being capable of penetrating, at least partially, inside the cylinder in which this piston is slidably mounted, the end of the piston in which is formed the bearing for rotation of the roller, comprising two recesses each corresponding at least to the space included between at least the cylindrical surface of the roller, the surface of the cylinder and one of the transverse faces of the roller, said space being open in the upper part of the piston at least in the zone where the cylindrical surface of the roller projects from the piston; and two pieces for wedging each roller, which are each disposed in one of said two recesses between the corresponding end of the roller and the inner face of the cylinder on which said wedging piece abuts, in order to ensure axial holding of the roller in position parallel to its axis of rotation.

The means for holding in position the rollers supported by the pistons, known by FR-A-2 582 058, are efficient, but require machinings which increase the cost price of the mechanism. Moreover, in order to obtain failure-free operation, the means for holding these known mechanisms must be mounted with precision which, again, tends to increase the cost of said assembly.

It is a principal object of the invention to reduce these machining and assembly costs, by reducing the number of necessary machinings and even eliminating certain, and by reducing and eliminating certain prior precision assemblies.

To that end, the invention provides an arrangement whereby, along the axis of the piston, at least one of the two wedging pieces extends up to the lower part of the recess, so as, in the sense of extension of the piston out of the cylinder, to be displaced with said piston.

The following advantageous arrangements are, in addition, preferably adopted:

that part of the wedging piece opposite the end of the roller is defined by a cylindrical face which is in abutment on the inner face of the cylinder;

the wedging piece is introduced in the corresponding recess without being fixed to any piece, in particular either to the piston or to the cylinder;

or, in a variant embodiment, the mechanism comprises a device for maintaining the orientation of the piston with respect to the cylinder;

this device for maintaining the orientation of the piston with respect to the cylinder is constituted by a groove, with which the wedging piece is provided, which extends parallel to the axis of the piston, which opens out in that face of this wedging piece opposite the corresponding end of the roller, and by a catch, which is fixed with respect to the cylinder vis-à-vis rotation about the axis of the piston and which is introduced, in said groove, so as to leave free the translation of said wedging piece with respect to the cylinder parallel to the axis of the piston;

the device for maintaining the orientation of the piston with respect to the cylinder comprises a clip having an arm constituting said catch and disposed in the upper part of the cylinder-block, being hooked to an edge of the outer part of said cylinder-block;

in a variant embodiment, the device for maintaining the orientation of the piston with respect to the cylinder is constituted by one of the two wedging pieces in the form of a support, which is fixed with respect to the cylinder, of an abutment face for limiting slide of the roller parallel to its axis;

this wedging piece in the form of a support is advantageously constituted by a lunule rendered fast with the cylinder-block;

at least certain of the wedging pieces disposed on at least one side of the transverse plane containing the axes of a plurality of pistons are each provided with a catch projecting opposite the abutment face of the roller and on which an elastic return device may be hooked, in order to allow the pistons to return in the cylinders until the rollers are brought out of abutment with the cam in a so-called "releasing" configuration of the mechanism;

at least one of said wedging pieces which extends substantially to the lower part of the recess, extends in addition to that part of the cylindrical surface of the roller which projects out of the piston, being included between these two limits, so as, in the sense of the return of the piston in the cylinder, to be pushed by the cam itself towards the inside of the cylinder;

in a variant embodiment, the roller is mounted in a bearing for rotation formed in the piston and projects axially beyond said bearing, of which the lower part is disposed at a level higher than that of the lower part of the corresponding recess of the piston, with the result that a housing is formed between the lower part of the recess and the end of the roller which projects axially beyond the bearing, whilst the lower part of the wedging piece presents, towards the corresponding end of the roller, a protuberance contained in said housing, so that the return displacement of the piston in the cylinder provokes a concomitant displacement of said wedging piece with respect to the cylinder;

the lower part of the recess coincides with the lower part of the bearing for rotating assembly of the roller.

The advantages offered by the invention are in connection with the fact that, in its most simple form, the device for axially holding a roller requires no machining of the cylinder-block, since it is constituted by two wedging pieces not fixed on the cylinder-block, either in translation in the direction of slide of the corresponding piston, or in rotation about the axis of the corresponding cylinder. In the event of rotation about the axis of the cylinder not being free, preferred arrangements are proposed which also avoid any important machining and/or precision of the cylinder-block. The principal advantage obtained resides in the reduction of the number of machinings and, especially, in the reduction or elimination of the machining of a cumbersome, heavy and expensive item, the cylinder-block. The reduction of the cost price of the mechanism corresponds to this reduction in the machinings obtained by adopting the invention.

BRIEF DESCRIPTION OF THE DRAWINGS

The invention will be more readily understood on reading the following description with reference to the accompanying drawings, in which:

FIG. 1 is a transverse section through the piston-cylinder assembly of a first variant embodiment of a mechanism according to the invention.

FIGS. 2A and 2B are half-sections along II—II of FIG. 1 corresponding to the two configurations of extension of the piston out of the cylinder and of retraction of the piston in said cylinder, respectively.

FIGS. 3A and 3B are half-sections along III—III of FIG. 1, corresponding to the two configurations mentioned above of extension out of and of retraction of the piston in the cylinder, respectively.

FIGS. 4A and 4B are half-sections, through the axis of the cylinder, of a second variant embodiment of a mechanism according to the invention, likewise in the two configurations mentioned above of extension and retraction of the piston, respectively.

FIG. 5 is a section along V—V of FIGS. 4A and 4B.

FIGS. 6A and 6B are half-sections through the axis of the cylinder, of a third variant embodiment of a mechanism according to the invention, likewise in the two configurations of extension and of retraction of the piston, respectively.

FIG. 7 is a section along VII—VII of FIGS. 6A and 6B.

FIGS. 10A and 10B are half-sections, through the axis of a cylinder, of a fifth variant embodiment of a mechanism according to the invention, in the two configurations of extension out of and of retraction in the corresponding cylinder, respectively, of the piston.

FIG. 11 is a section along XI—XI of FIGS. 10A and 10B.

FIG. 12 is a view in the direction of arrow F of FIG. 10A.

FIGS. 15A and 15B are half-sections along XVA—XVA and XVB—XVB of FIGS. 16A and 16B, respectively, of a seventh variant embodiment of a mechanism according to the invention, in the two configurations of the piston corresponding to its extension out of and to its retraction in the corresponding cylinder, respectively.

FIGS. 16A and 16B are half-sections along XVIA—XVIA and XVIB—XVIB of FIGS. 15A and 15B, respectively.

FIG. 17 is a section along XVII—XVII of FIGS. 15A and 15B.

FIG. 18 is a perspective view of one of the two wedging pieces of the mechanism of FIGS. 15A and 15B, and FIG. 19 is a general axial section of a motor according to the invention.

DETAILED DESCRIPTION OF THE DRAWINGS

Figure 8:
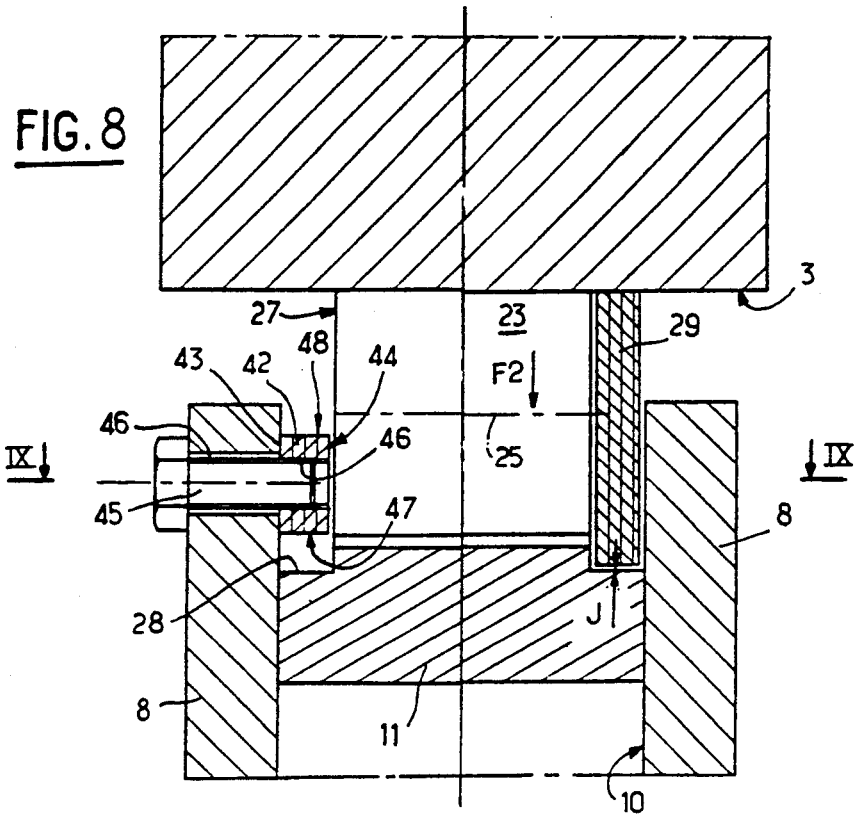
FIG. 8 is a section along VIII—VIII of FIG. 9 of a fourth variant embodiment of a mechanism according to the invention, in the configuration of retraction of the piston in the corresponding cylinder.

Referring now to the drawings, the motor of FIG. 19 is constituted by:

- a casing in two parts l*a*, 1*b* assembled together by screws 2;
- an undulated cam 3, fast with the casing 1*a*–1*b;*
- a driven shaft 4, mounted to rotate in the casing, around a spindle 5, by means of two roller bearings 6 and of which, the inner end is provided with splines 7;
- a cylinder-block 8 which comprises a central recess provided with splines 9, associated with the splines 7 of the shaft to connect shaft 4 in rotation with the cylinder-block 8 and to center this cylinder-block with respect to this shaft;
- a plurality of cylinders 10 disposed radially in star form with respect to spindle 5, each containing a piston 11 which is slidably mounted therein;
- a flat face 12 with which the cylinder-block 8 is provided, which is perpendicular to the axis of rotation 5 and in which open out conduits 13 connected to the different cylinders 10;
- a slide valve 14 for distributing fluid to the various cylinders 10, which is provided with a flat face 15, perpendicular to the axis of rotation 5 and disposed opposite and in abutment on the face 12 of the cylinder-block, and which comprises two circular grooves 16, 17 communicating respectively with a source of fluid under pressure 18 and with a reservoir 19 of fluid not under pressure, whilst a device 20, with catch and stirrup, renders this slide valve 14 fast in rotation with part la of the casing, and conduits 21, 22 connect the grooves 16, 17 respectively to the flat face 15 and are capable of being placed in communication, successively, during relative rotation of the cylinder-block 8 with respect to the slide valve 14, with the conduits 13 of the cylinder-block.

A cylindrical roller 23 is housed in a bearing 24 made at the end of each piston 11, is mounted to rotate about a roller axis 25 at right angles to the piston axis 26 of said piston and is in abutment on the cam 3. This roller 23 is capable of penetrating, at least partially, inside the cylinder, with the result that, at each transverse face 27 defining the roller, a recess 28 is formed in that part of the piston 11 which supports this roller, which makes it possible to constitute spaces on either side of said roller. Each recess corresponds at least to the space included between at least the surface of the cylinder 10, the cylindrical surface of the roller 23 and the corresponding transverse face 27 of the roller, said space being furthermore open in the upper part of the piston, at least in the zone where the roller projects out of the piston.

The arrangements which have just been described are found in each variant embodiment shown. In the variants shown, the plane perpendicular to the axis 25 of the roller 23 and containing the axis 26 of the piston, is a plane of symmetry for the piston 1, the bearing 24, the roller 23 and the two so-called spaces. It would also be possible, and in accordance with the invention, to have a dissymetrical arrangement in which the spaces are not symmetrical to each other with respect to a plane perpendicular to the axis 5 of the roller.

For each embodiment, a means should be provided for holding in axial position in its bearing 24 the roller 23 mounted on a piston 11 and for maintaining constant its angular orientation with respect to the axis 26 of the piston, in order to arrange for this roller 23 to be disposed opposite cam 3 and correctly oriented with respect to said cam to roll on the cam. The means which have been provided to attain this object are different from one embodiment to the other and will now be described.

In the embodiment of FIGS. 1, 2A, 2B, 3A and 3B, each space defined between a recess 28 of the piston 11 and the inner wall of the cylinder 10 contains a wedging piece 29, of corresponding shape, whose transverse section is shaped substantially as a lunule (FIG. 1). This wedging piece 29 has a flat face 29A disposed opposite one of the end faces 27 of the roller 23 and a cylindrical face 29B in abutment on the inner face of the cylinder 10 and therefore effects axial wedging of the roller in the sense of placing the face 27 of the roller in abutment on face 29A of the piece 29.

In this embodiment, each piece 29 extends, between the lower part of the recess 28 and the cam 3, to within a small clearance J. When piston 11 extends out of cylinder 10 (arrow Fl), the pieces 29 are in abutment on the lower bottom of the respective recesses 28 and are spaced apart from cam 3 by a distance equal to clearance J (FIGS. 2A and 3A). When, on the contrary, piston 11 retracts inside cylinder 10, in the direction of arrow F2 (FIGS. 2B and 3B), each piece 29 is pushed inside the cylinder 10 by cam 3 and the clearance J is found between the lower part of each piece 29 and the lower bottom of the corresponding recess 28.

It should be noted that the bearing 24 is here constituted by the inner face of an added bearing bush 30 and that the two pieces 29 used are identical. Each of them is slid in the recess 28 without being fixed to any other piece.

In the embodiment which has just been described, the orientation of the piston with respect to its axis 26 is effected only by the abutment of roller 23 on cam 3: experience has shown that, in the mechanisms such as hydraulic motors, having a permanent abutment of the rollers 23 of the various pistons on cam 3, the orientation of each piston with respect to its axis 26 remains constant and the corresponding roller 23 also remains correctly oriented in order to be able to roll on cam 3.

However, certain mechanisms do not have such permanent abutment of the various rollers on the cam 3. In that case, they should be provided with a complementary arrangement: the embodiment of FIGS. 4A, 4B and 5 comprises such an arrangement.

In this embodiment, the roller 23 projects, in width, beyond the bearing 24 which supports it and the bottom of the recess is located at a level lower than that of said bearing, with the result that a housing 31 is defined, by the lower face of the roller 23 and by the recess of the piston, inside which a protuberance 32, that each piece 29 comprises, is disposed, a slight clearance K allowing the protuberance 32 to penetrate easily in said housing 31. When piston 11 extends out of cylinder 10 (FIG. 4A), in the direction of arrow Fl, each of the pieces 29 is pushed by the bottom of the recess and emerges with it, without being in contact with the cam 3, and the clearance K separates the upper face of the protuberance 32 from the lower face of the end of the roller 23.

When piston 11 retracts into cylinder 10, in the direction of arrow F2 (FIG. 4B), the cam 3 pushes roller 23, the piece 29 is still not in contact with the cam 3, and the clearance K this time separates the lower face of the protuberance 32 from the lower bottom of housing 31. The piece 29 also retracts inside the cylinder, being driven by the abutment of its upper edge with the lower face of the end of the roller 23. These arrangements effect axial wedging of the roller.

The embodiment of FIGS. 4A, 4B and 5 comprises an additional particular feature: one of the pieces 29 comprises a vertical groove 33 parallel to the axis 26 of the piston 11, which opens out in the upper end 29C of the piece 29, and inside which is introduced the end 34, forming slide block, of a screw 35 screwed in a tapping 36 machined in the wall of cylinder 10. Of course, the pieces 29 of FIGS. 2A, 2B, 3A, 3B may, like those of the following Figures, be provided with such a device which prevents any rotation of the corresponding piece 29 about the axis 26 of the piston, and which, consequently, maintains constant the orientation of said piston 11 about axis 26, with respect to cylinder 10.

The embodiment of FIGS. 6A, 6B and 7 takes up the principle of the introduction of pieces 29 without protuberance (as in FIGS. 2A, 2B, 3A and 3B), with, however, a variation in the design of the device for maintaining orientation of the piston 11, about axis 26, with respect to cylinder 10. One of the pieces 29 comprises, similarly to the arrangement of FIGS. 4A and 4B, a groove 33 in which is introduced an arm 37 of a U-shaped clip which overlaps the end edge 38 of the wall of the cylinder-block 8 and of which the other arm 41 is hooked, after elastic deformation for clipping, in a groove 39 made in the outer face 40 of the wall of the cylinder-block 8. The second piece 29 is identical to those used in the embodiment of FIGS. 2A, 2B, 3A, 3B.

Clearance J defined with regard to FIGS. 2A, B, 3A and 3B is found again, as well as: 'on the one hand, the operation, already explained, of the embodiment shown in said Figures, in connection with pieces 29 not provided with protuberances;

on the other hand, the maintenance of the orientation of that piece 29 which comprises the groove 33 and therefore the maintenance of the orientation of the piston 11 about axis 26, with respect to cylinder 10.

Figure 9:
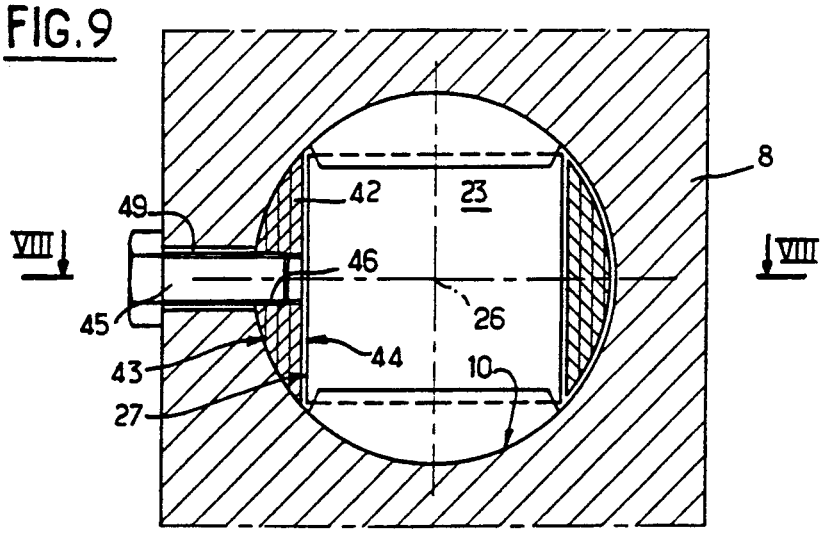
FIG. 9 is a section along IX—IX of FIG. 8.

The embodiment of FIGS. 8 and 9 employs, on the one hand, a wedging piece 29, shown in the right-hand half of each of the Figures, similar to the one described with regard to FIGS. 2A, 2B, 3A and 3B, on the other hand, a lunule 42, fixed with respect to the cylinder-block 8 shown in the left-hand half of each of FIGS. 8 and 9. This lunule 42 comprises a cylindrical face 43, of the same radius as cylinder 10, and in abutment the inner face of this cylinder, and a flat face 44, disposed opposite and in the immediate vicinity of the flat end face 27 of the roller 23. The lunule 42 comprises in addition a tapping 46 which cooperates with a screw 45, passing through a hole 49 in the wall of the cylinder-block 8, for fixing said lunule 42 on the cylinder-block 8. Contrary to the pieces 29 described hereinbefore, the lunule 42 does not slide concomitantly to the slide of the piston 11 and does not need to be pushed either by cam 3 or by the bottom of recess 28: this is why the lunule 42 does not descend to the bottom of the recess 28 (lower transverse plane 47 distinct from the bottom of the recess), nor does it rise up to cam 3 (upper transverse plane 48 not merged with, nor adjacent the upper generatrix of roller 23). This lunule 42 maintains orientation of the piston 11 about axis 26, with respect to cylinder 10.

The embodiment of FIGS. 10A, 10B, 11 and 12 comprises, on the one hand, two wedging pieces 29 similar to those of the embodiment of FIGS. 2A, 2B, 3A and 3B, on the other hand, a complementary arrangement adapted to the wedging piece 29 shown in FIG. 10A, in the left-hand half of FIG. 11 and in FIG. 12.

According to this complementary arrangement, a clip 50, with two arms 51 and 52, overlaps the upper end edge 38 of the cylinder-block 8; has its arm 51 introduced in a housing 53 made in the corresponding wedging piece 29 and opening out in the upper edge 29C of this wedging piece; and has its arm 52, outside the cylinder-block 8, which terminates in a hook 54. Individual springs 55 are coupled either directly, as shown in the Figures, or indirectly, each to the hooks 54 of clips corresponding to two consecutive pistons. The clips 50 and springs 55 are all disposed on the same side of the plane containing the axes 26 of the various pistons.

Figure 13A:
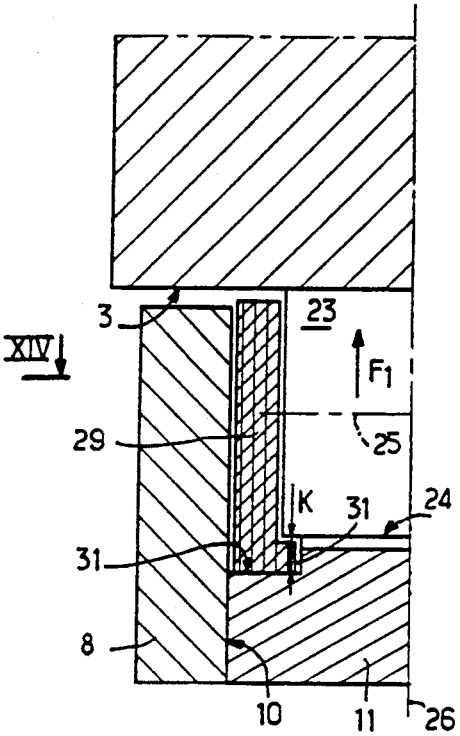
FIGS. 13A and 13B are half-sections through the axis of a cylinder, of a sixth variant embodiment of a mechanism according to the invention, in the two configurations of extension out of and of retraction in the cylinder, respectively, of the piston.
Figure 13B:
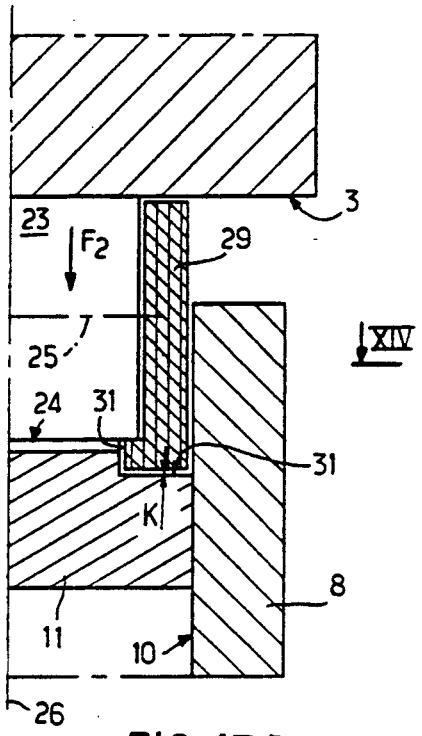
Figure 14:
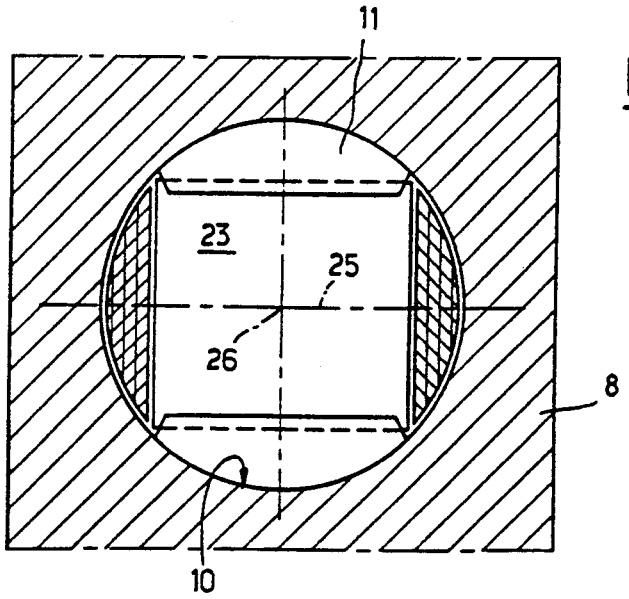
FIG. 14 is a view along XIV—XIV of FIGS. 13A and 13B.

The embodiment of FIGS. 13A, 13B and 14 comprises two wedging pieces 29 similar to the one shown in FIG. 4B and in the right-hand half of FIG. 5.

The embodiment of FIGS. 15A, 15B, 16A, 16B, 17 and 18 resembles that of FIGS. 2A, 2B, 3A and 3B, with the following particular features:

- on the one hand, the lower bottom of each recess 28 of the piston 11 is located at the same level and has the same transverse contour as the bottom 56 of the housing of the piston 11 which supports the bearing bush 24;
- each wedging piece 57 is inscribed, transversely, in the geometrical cylinder which extends the lower part of the bottom 56 and the upper part of the roller 23.

Such a wedging piece 57 therefore corresponds, as to its functioning, to the wedging pieces 29 of FIGS. 2A, 2B, with the same clearance J, but has a truncated shape with respect to these wedging pieces 29. FIG. 18 shows in perspective a wedging piece 57, whilst, concerning the functional aspect, more particularly illustrated with regard to FIG. 17, a complete similitude of this FIG. 17 with FIG. 1 corresponding to the embodiment of FIGS. 2A, 2B, 3A and 3B, will be noted.

The various embodiments described allow axial wedging of the roller 23 in the bearing 24 with respect to piston 11.

In fact, whether it be question of the embodiments comprising two wedging pieces 29 (FIGS. 1, 2A, 2B, 3A and 3B; 4A, 4B and 5; 6A, 6B and 7; 10A, 10B, 11 and 12; 13A, 13B and 14), or of the one comprising a wedging piece 29 and a lunule 42 (FIGS. 8 and 9); or, finally, of the one comprising two wedging pieces 57 (FIGS. 15A, 15B, 16A, 16B, 17 and 18), the transverse flat end faces 27 of the roller 23 are disposed opposite and adjacent the flat faces of the wedging pieces 29, 57 or the lunule 42, said wedging pieces and lunule being in addition in abutment on the inner face of the cylinder 10.

The most simple embodiment is obviously that of FIGS. 1, 2A, 2B, 3A and 3B, since the corresponding pieces 29 are solely slid inside the recesses 28.

The only machinings necessary are therefore those of said recesses, made on small pieces (pistons 11) and are simple machinings (for example millings). In this embodiment, the efforts of abutment of rollers 23 on cam 3 bring about the automatic alignment of the axis 25 of each roller 23 parallel to the axis of rotation 5, and thus maintain constant the orientation of each piston 11 with respect to the axis 26 of its slide.

From this viewpoint, the embodiment of FIGS. 15A, 15B, 16A, 17B, 17 and 18 presents the same functional characteristics, with a recess corresponding only to the opening of the bore 56 of the piston enabling it to receive the bearing 24 and to the bore enabling it to receive the roller 23, which correspond to machinings already necessary for the support of the roller 23. In certain mechanisms, such as those in which the pistons 11 may be retracted, either voluntarily inside the cylinders 10 (embodiment * of FIGS. 10A, 10B, 11 and 12), or retracted involuntarily inside said cylinders 10, when, for example, before the first start-up, no pressurized fluid pushes the pistons so that the rollers 23 are themselves maintained in abutment on cam 3, the orientation of the pistons should be maintained constant with respect to the cylinder-block 8, so as to maintain their axes 25 parallel to the axis of rotation 5. The arrangements of the embodiments of FIGS. 4A, 4B and 5, with the end 34 introduced in the groove 33; of FIGS. 6A, 6B and 7, with arm 37 introduced in groove 33; of FIGS. 8 and 9, with the lunule 42, fixed with respect to cylinder 10; and of FIGS. 10A, 10B, 11 and 12 with the clips 50 and corresponding pieces 29, virtually oriented in a constant orientation with respect to the corresponding cylinders, make it possible to maintain constant the orientation of each roller 23 with respect to the corresponding cylinder 10, even when said roller is no longer in abutment on the cam 3, this orientation being such that the axis 25 of the roller remains parallel to the axis of rotation 5.

It may, furthermore, be desired that the wedging pieces 29 be returned inside the cylinders 10, not by being pushed by cam 3 which is nonetheless efficient (FIGS. 2B, 6B, 8, 10B or FIG. 15B concerning the wedging piece 57), but returned without contact with the cam: the arrangements of FIGS. 4B and 13B allow such a return, during the stroke of retraction of the piston 11 inside the cylinder 10.

Finally, as shown in FIGS. 10A, 10B, 11 and 12, the corresponding embodiment makes it possible to "release" certain pistons 11, i.e., the corresponding cylinders not being supplied, to place the rollers 23 of the corresponding pistons 11 out of abutment with cam 3.

The invention is not limited to the embodiments shown, but covers, on the contrary, all the variants that may be made thereto without departing from their scope nor spirit.

What is claimed is:

1. A hydraulic mechanism, motor or pump, comprising:

- a cam;
- a cylinder-block mounted to rotate with respect to the cam;
- a plurality of cylinders arranged in this cylinder-block;
- a plurality of pistons each mounted to slide inside a cylinder along an axis of slide of piston;
- a plurality of rollers for rolling abutment of the pistons on the cam, each roller being mounted on a piston, rotating about a roller axis perpendicular to the axis of slide of said piston by means of a bearing for rotation, being axially defined by two transverse faces, and being capable of penetrating, at least partially, inside the cylinder in which this piston is slidably mounted, the end of the piston, in which is formed the bearing for rotation of the roller, comprising two recesses each corresponding to the space included between the cylindrical surfaces of the roller, and between the inner surface of the cylinder and one of the transverse faces of the roller, and defining a lower part for each recess thereon, said space being open in the upper part of the piston where the cylindrical surface of the roller projects from the piston; and two wedging pieces for each roller, which are each disposed in one of said two recesses between the corresponding end of the roller and the inner face of the cylinder on which said wedging piece abuts, in order to ensure axial holding in position of the roller parallel to its axis of rotation, wherein, along the axis of the piston, at least one of the two wedging pieces extends up to the lower part of the recess, so as to move with the piston during the extension of the piston out of the cylinder.

2. The mechanism of claim 1, wherein that part of the wedging piece opposite the transverse face of the roller is defined by a cylindrical face which is in abutment on the inner face of the cylinder.

3. The mechanism of either one of claims 1 and 2, wherein said wedging piece is in the corresponding recess without being fixed to any piece, in particular without being fixed to either the piston or the cylinder.

4. The mechanism of either one of claims 1 and 2, wherein it comprises a device for maintaining the orientation of the piston with respect to the cylinder.

5. The mechanism of claim 4, wherein the device for maintaining the orientation of the piston with respect to the cylinder is constituted by a groove, with which the wedging piece is provided, which extends parallel to the axis of the piston, which opens out in that face of this wedging piece opposite the corresponding transverse face of the roller, and by a screw, which is fixed to the cylinder relative to rotation about the axis of the piston and which is contained in said groove.

6. The mechanism of claim 5, wherein the device for maintaining the orientation of the piston with respect to the cylinder comprises a clip having an arm extending in the groove for substitute of the screw and disposed in the upper part of the cylinder-block, being hooked to an edge of the outer part of said cylinder-block.

7. The mechanism of claim 4, wherein the device for maintaining the orientation of the piston with respect to the cylinder is constituted by one of the two wedging pieces in the form of a support, which is fixed with respect to the cylinder, of an abutment face for limiting slide of the roller parallel to its axis.

8. The mechanism of claim 7, wherein this wedging piece in the form of a support is constituted by a lunule rendered fast with the cylinder-block.

9. The mechanism of claim 1, wherein at least certain of the wedging pieces disposed on at least one side of the transverse plane containing the axes of a plurality of pistons are each provided with a hook projecting opposite the abutment face of the roller and on which an elastic return device may be hooked, in order to allow the pistons to return in the cylinders until the rollers are brought out of abutment with the cam in a so-called "releasing" configuration of the mechanism.

10. The mechanism of claim 1, wherein at least one of said wedging pieces, which extends substantially to the lower part of the recess, extends up to the cylindrical surface of the roller which projects out of the piston, so as, in the sense of the return of the piston in the cylinder, to be pushed by the cam itself towards the inside of the cylinder.

11. The mechanism of claim 1, wherein the roller projects axially beyond said bearing, and the lower part of said bearing is disposed at a level higher than that of the lower part of the corresponding recess of the piston, with the result that a housing is formed between the lower part of the recess and part of the cylindrical surface of the roller which projects axially beyond the bearing, whilst the lower part of the wedging piece presents, towards the corresponding transverse face of the roller, a protuberance contained in said housing, so that the return displacement of the piston in the cylinder provokes a concomitant displacement of said wedging piece with respect to the cylinder.

12. The mechanism of claim 1, wherein the lower part of the recess coincides with the lower part of the bearing for rotating assembly of the roller.

* * * * *